US008587494B2

(12) United States Patent
Lee et al.

(10) Patent No.: US 8,587,494 B2
(45) Date of Patent: Nov. 19, 2013

(54) INTERNAL ANTENNA PROVIDING IMPEDANCE MATCHING FOR MULTIBAND

(75) Inventors: Jin-Woo Lee, Kyeonggi-do (KR); Byong-Nam Kim, Kyeonggi-do (KR); Joo-Sung Kim, Incheon-si (KR)

(73) Assignee: Ace Technologies Corp., Incheon-Si (KR)

( * ) Notice: Subject to any disclaimer, the term of this patent is extended or adjusted under 35 U.S.C. 154(b) by 563 days.

(21) Appl. No.: 12/935,195

(22) PCT Filed: Mar. 30, 2009

(86) PCT No.: PCT/KR2009/001608

§ 371 (c)(1), (2), (4) Date: Nov. 9, 2010

(87) PCT Pub. No.: WO2009/145437

PCT Pub. Date: Dec. 3, 2009

(65) Prior Publication Data

US 2011/0043427 A1 Feb. 24, 2011

(30) Foreign Application Priority Data

Mar. 31, 2008 (KR) ..... 10-2008-0029714

(51) Int. Cl.
*H01Q 1/50* (2006.01)
*H01Q 1/38* (2006.01)

(52) U.S. Cl.
USPC ..... 343/850; 343/700 MS

(58) Field of Classification Search
USPC ..... 343/850, 700 MS
See application file for complete search history.

(56) References Cited

U.S. PATENT DOCUMENTS

| | | | | |
|---|---|---|---|---|
| 6,734,825 | B1 * | 5/2004 | Guo et al. | 343/700 MS |
| 7,324,050 | B2 * | 1/2008 | Chung et al. | 343/700 MS |
| 2007/0008224 | A1 * | 1/2007 | Chung et al. | 343/700 MS |

FOREIGN PATENT DOCUMENTS

| | | | |
|---|---|---|---|
| JP | 2004172912 | A | 6/2004 |
| JP | 2006197254 | A | 7/2006 |
| JP | 2007123982 | A1 | 5/2007 |

OTHER PUBLICATIONS

International Search Report issued on Nov. 13, 2009 from International Application No. PCT/KR2009/001608.

Wang, Hanyang et al., 'Input Impedance-Tuning Slots of PIFA Antennas' In: Proceedings of 2nd European Conference on Antennas and Propagation, Nov. 11-16, 2007, Edinburgh, UK, pp. 1-4.

* cited by examiner

*Primary Examiner* — Jacob Y Choi
*Assistant Examiner* — Graham Smith
(74) *Attorney, Agent, or Firm* — Duane Morris LLP

(57) ABSTRACT

Disclosed is an internal antenna that provides impedance matching for multiple bands. The antenna includes an impedance matching part, which in turn includes a first conductive element electrically coupled to a feeding point and a second conductive element electrically coupled to a ground, and at least one radiator electrically coupled to the first conductive element, where the first conductive element and the second conductive element of the impedance matching part are separated by a particular distance to perform coupling matching and are electrically coupled at a pre-designated position. Certain aspects of the present invention can be utilized to provide wide band characteristics in designing for multi-band applications, even for high-frequency bands.

6 Claims, 6 Drawing Sheets

INTERNAL ANTENNA PROVIDING IMPEDANCE MATCHING FOR MULTIBAND

TECHNICAL FIELD

The present invention relates to an antenna, more particularly to an internal antenna that provides impedance matching for multiple bands.

BACKGROUND ART

In current mobile terminals, there is a demand not only for smaller sizes and lighter weight, but also for functions that allow a user access to mobile communication services of different frequency bands through a single terminal. That is, there is a demand for a terminal with which a user may simultaneously utilize signals of multiple bands as necessary, from among mobile communication services of various frequency bands, such as the CDMA service based on the 824~894 MHz band and the PCS service based on the 1750~1870 MHz band commercialized in Korea, the CDMA service based on the 832~925 MHz band commercialized in Japan, the PCS service based on the 1850~1990 MHz commercialized in the United States, the GSM service based on the 880~960 MHz band commercialized in Europe and China, and the DCS service based on the 1710~1880 MHz band commercialized in parts of Europe. Accordingly, there is a demand for an antenna having wide band characteristics to accommodate these multiple bands.

Furthermore, there is a demand for a composite terminal that allows the use of services such as Bluetooth, ZigBee, wireless LAN, GPS, etc. In this type of terminal for using services of multiple bands, a multi-band antenna is needed, which can operate in two or more desired bands. The antennas generally used in mobile terminals include the helical antenna and the planar inverted-F antenna (PIFA).

Here, the helical antenna is an external antenna that is secured to an upper end of a terminal, and is used together with a monopole antenna. In an arrangement in which a helical antenna and a monopole antenna are used together, extending the antenna from the main body of the terminal allows the antenna to operate as a monopole antenna, while retracting the antenna allows the antenna to operate as a $\lambda/4$ helical antenna. While this type of antenna has the advantage of high gain, its non-directivity results in undesirable SAR characteristics, which form the criteria for levels of electromagnetic radiation hazardous to the human body. Also, since the helical antenna protrudes outwards from the terminal, it is difficult to design the exterior of the terminal to be aesthetically pleasing and suitable for carrying, but a built-in structure for the helical antenna has not yet been researched.

The inverted-F antenna is an antenna designed to have a low profile structure in order to overcome such drawbacks. The inverted-F antenna has directivity, and when current induction to the radiating part generates beams, a beam flux directed toward the ground surface may be re-induced to attenuate another beam flux directed toward the human body, thereby improving SAR characteristics as well as enhancing beam intensity induced to the radiation part. Also, the inverted-F antenna operates as a rectangular micro-strip antenna, in which the length of a rectangular plate-shaped radiating part is reduced in half, whereby a low profile structure may be realized.

Because the inverted-F antenna has directive radiation characteristics, so that the intensity of beams directed toward the human body may be attenuated and the intensity of beams directed away from the human body may be intensified, a higher absorption rate of electromagnetic radiation can be obtained, compared to the helical antenna. However, the inverted-F antenna may have a narrow frequency bandwidth when it is designed to operate in multiple bands.

Thus, there is a demand for an antenna that maintains a low profile structure for more stable operation in multiple bands and overcomes the drawback of the inverted-F antenna of narrow band characteristics.

DISCLOSURE

Technical Problem

To resolve the problems in prior art described above, an objective of the present invention is to provide a multi-band internal antenna that exhibits wide band characteristics even for multi-band designs.

Another objective of the present invention is to provide a multi-band internal antenna having a low profile that is capable of resolving the problem of narrow band characteristics found in typical inverted-F antennas.

Additional objectives of the present invention will be obvious from the embodiments described below.

Technical Solution

To achieve the objectives above, an aspect of the present provides a multi-band internal antenna that includes an impedance matching part, which in turn includes a first conductive element electrically coupled to a feeding point and a second conductive element electrically coupled to a ground, and at least one radiator electrically coupled to the first conductive element, where the first conductive element and the second conductive element of the impedance matching part are separated by a particular distance to perform coupling matching and are electrically coupled at a pre-designated position.

The antenna can further include a plurality of first coupling elements protruding from the first conductive element and a plurality of second coupling elements protruding from the second conductive element.

An open stub can be formed at the position where the first conductive element and the second conductive element are electrically coupled.

The first coupling elements and the second coupling elements protruding from the first conductive element and the second conductive element, respectively, may form a generally comb-like arrangement.

The first coupling elements and the second coupling elements can have partially varying widths and lengths.

Another aspect of the present invention provides a multi-band internal antenna that includes an impedance matching part, which in turn includes a first conductive element electrically coupled to a feeding point and a second conductive element electrically coupled to a ground, and a radiator, where the first conductive element and the second conductive element of the impedance matching part are separated by a particular distance to perform coupling matching and are electrically coupled at a pre-designated position, and the radiator is electrically coupled to the position where the first conductive element and the second conductive element are electrically coupled.

Yet another aspect of the present invention provides a multi-band internal antenna that includes an impedance matching part, which in turn includes a first conductive element electrically coupled to a feeding point and a second conductive element electrically coupled to a ground, and at least one radiator electrically coupled to the impedance matching part, where the first conductive element and the second conductive element of the impedance matching part are separated by a particular distance to perform coupling matching and are electrically coupled at a pre-designated position.

Advantageous Effects

Certain aspects of the present invention utilize coupling matching in designing for multi-band applications, to provide wide band characteristics, which are especially effective in high-frequency bands.

MODE FOR INVENTION

The multi-band internal antenna according to certain embodiments of the present invention will be described below in more detail with reference to the accompanying drawings.

Figure 1:
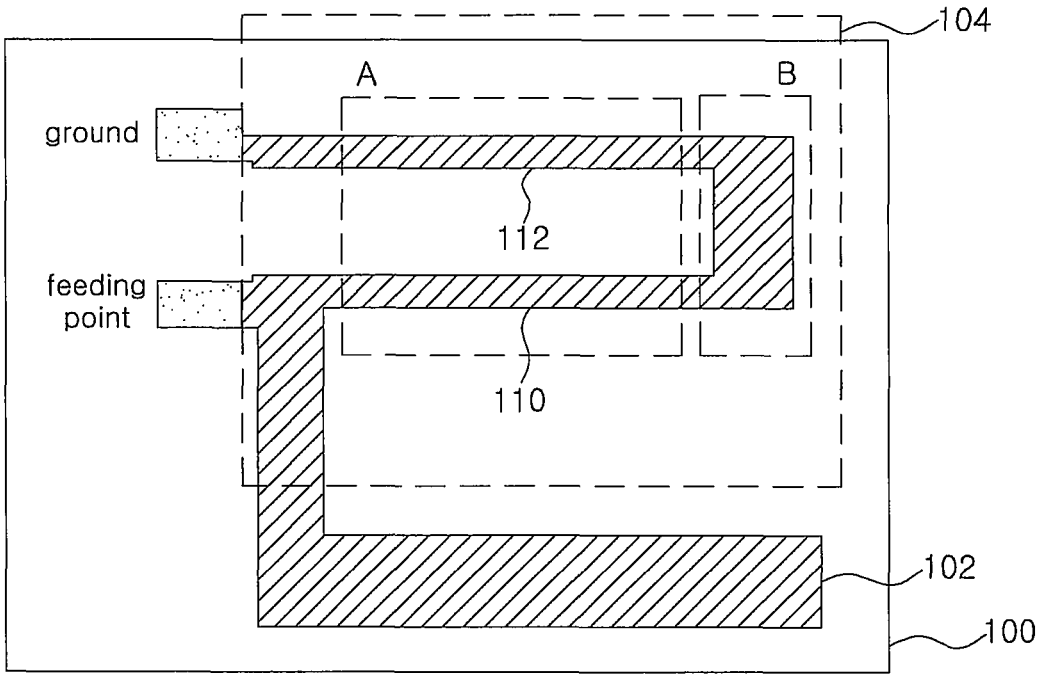
FIG. 1 illustrates the structure of a multi-band internal antenna according to a first disclosed embodiment of the present invention.

FIG. 1 illustrates the structure of a multi-band internal antenna according to a first disclosed embodiment of the present invention.

Referring to FIG. 1, a multi-band internal antenna according to a first disclosed embodiment of the present invention may include a board 100, a radiator 102 formed on the board, and an impedance matching part 104.

In FIG. 1, the board 100 may be made of a dielectric material, to which other components may be joined. A variety of dielectric materials can be applied as the board 100, such as a PCB, FR4 board, for example, while an antenna carrier may also be used for the board 100.

The radiator 102 may radiate RF signals of a predefined frequency band to the outside, and may receive RF signals of a predefined frequency band from the outside. While FIG. 1 illustrates a radiation element having an "L" shape, various other shapes can be applied for the radiator 102, such as a linear shape or a meandering shape.

FIG. 1 illustrates an example in which the radiator 102 is electrically coupled to a first conductive element 110, but as described later with reference to another embodiment, the radiator 102 can also be electrically coupled to a portion where the first conductive element 110 joins with a second conductive element.

The impedance matching part 104 may include a first conductive element 110, which is electrically coupled to a feeding point, and a second conductive element 112, which is electrically coupled to a ground. The first conductive element and the second conductive element may be separated by a certain gap in-between, and electrically coupled at a particular position (B).

In area A of the impedance matching part 106 where the first conductive element 110 and second conductive element 112 are separated by a particular distance, impedance matching may be performed by way of coupling. In area B, the first conductive element 110 and the second conductive element 112 may be electrically coupled.

While it is not illustrated in FIG. 1, open stubs can be formed in area B, where the first conductive element 110 and second conductive element 112 are electrically coupled, with the open stubs providing auxiliary impedance matching.

A structure having two conductive elements separated from each other to provide coupling matching, as described above, enables impedance matching for a wider band.

While FIG. 1 illustrates an example in which the first conductive element 110 and the second conductive element 112 are parallel and maintain a constant distance from each other, other structures can be implemented in which the first conductive element 110 and the second conductive element 112 are not parallel. That is, the first conductive element 110 and the second conductive element 112 can have a varying distance in-between, such as by including bends in certain portions.

Figure 2:
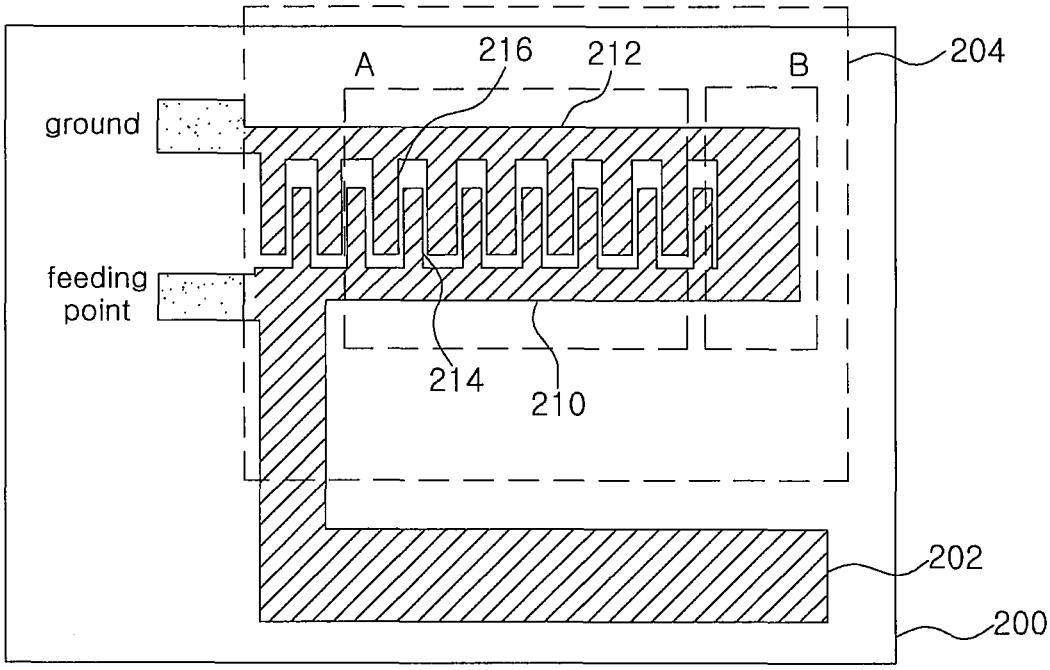
FIG. 2 illustrates the structure of a multi-band internal antenna according to a second disclosed embodiment of the present invention.

FIG. 2 illustrates the structure of a multi-band internal antenna according to a second disclosed embodiment of the present invention.

Referring to FIG. 2, a multi-band internal antenna according to a second disclosed embodiment of the present invention may include a board 200, a radiator 202 formed on the board, and an impedance matching part 204, where the impedance matching part 204 may include a first conductive element 210, a second conductive element 212, a plurality of first coupling elements 214 protruding from the first conductive element 210, and a plurality of second coupling elements 216 protruding from the second conductive element 212.

Referring to FIG. 2, the shapes and functions of the radiator 202 and the board 200 may be substantially the same as those of the first disclosed embodiment illustrated in FIG. 1, while the structure of the impedance matching part 204 may be different from that of the first disclosed embodiment.

When coupling matching is performed based on the interaction between the first conductive element 210 and the second conductive element 212, the capacitance component may play a greater role than the inductance component, and as such, better wide-band characteristics can be obtained when a larger capacitance component is provided and the capacitance component is more diversified.

Also, to obtain matching for a wide band, a particular amount of length is required for the impedance matching part such that sufficient coupling is achieved.

Furthermore, when there is a large capacitance component, the impact of external factors that are caused by high capacitance values, such as the hand effect, can be reduced.

Referring to FIG. 2, in order to diversify the capacitance component and enable coupling by a larger capacitance component, as well as to substantially increase the electrical length of the impedance matching part, the first coupling elements 214 and the second coupling elements 216 may additionally be included.

The first coupling elements 214 and second coupling elements 216 may protrude in rectangular shapes from the first conductive element 210 and second conductive element 212, respectively, and may be arranged alternately to form generally comb-like shapes.

These first coupling elements 214 and second coupling elements 216 may substantially narrow the distance between the first conductive element 210 and second conductive element 212, to not only provide a higher capacitance component, but also aid in diversifying the capacitance component, so as to enable matching for wider bands.

The impedance matching part according to the second disclosed embodiment may have the first conductive element 210 and the second conductive element 212 also electrically coupled at a particular position B. Moreover, while it is not illustrated in FIG. 2, open stubs may be formed at the position where the first conductive element 210 and second conductive element 212 are electrically coupled, in order to provide more efficient impedance matching.

FIG. 2 illustrates the protrusions of the first coupling elements 214 and second coupling elements 216 as having rectangular shapes, but the first and second coupling elements can be formed in various other shapes.

Figure 3:
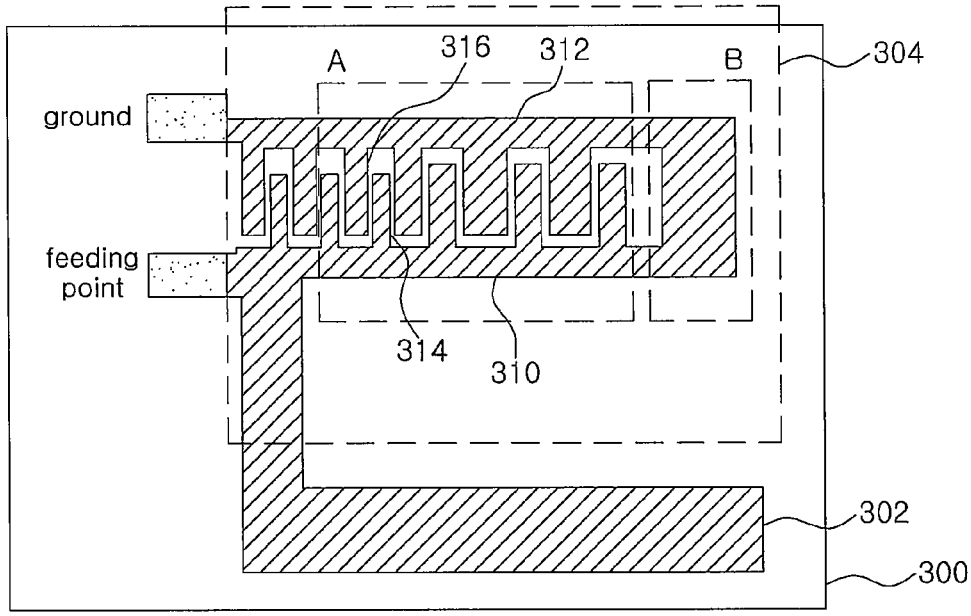
FIG. 3 illustrates the structure of a multi-band internal antenna according to a third disclosed embodiment of the present invention.

FIG. 3 illustrates the structure of a multi-band internal antenna according to a third disclosed embodiment of the present invention.

Referring to FIG. 3, a multi-band internal antenna according to a third disclosed embodiment of the present invention may include a board 300, a radiator 302, and an impedance matching part 304, where the impedance matching part 304 may include a first conductive element 310 electrically coupled to a feeding point, a second conductive element 312 electrically coupled to a ground, a plurality of first coupling elements 314 protruding from the first conductive element 310, and a plurality of second coupling elements 316 protruding from the second conductive element 312.

In the antenna according to the third disclosed embodiment, the components of the impedance matching part 304 may be substantially the same as those of the second disclosed embodiment, while the structure in which the first coupling elements 314 and second coupling elements 316 are formed may be different from that of the second disclosed embodiment.

In the second disclosed embodiment, the first coupling elements 314 and second coupling elements 316 have uniform protrusion lengths and widths. According to the third disclosed embodiment of the present invention, however, the first coupling elements 314 and second coupling elements 316 may have varying protrusion lengths and widths, as illustrated in FIG. 3.

FIG. 3 illustrates an example in which the width and length of the first coupling elements 314 protruding from the first conductive element 310 gradually increase towards the middle and then decrease again. Also, the second coupling elements 316 protruding from the second conductive element 312 maintain the same protrusion length but gradually increase in width.

By thus varying the widths and lengths of the coupling elements 314, 316, in the third disclosed embodiment, the diversity of the capacitance component can be maximized. The widths and lengths of the coupling elements can be applied in a variety of arrangements.

For example, the coupling elements can have either varying widths or varying lengths, or can have both varying widths and varying lengths.

Figure 8:
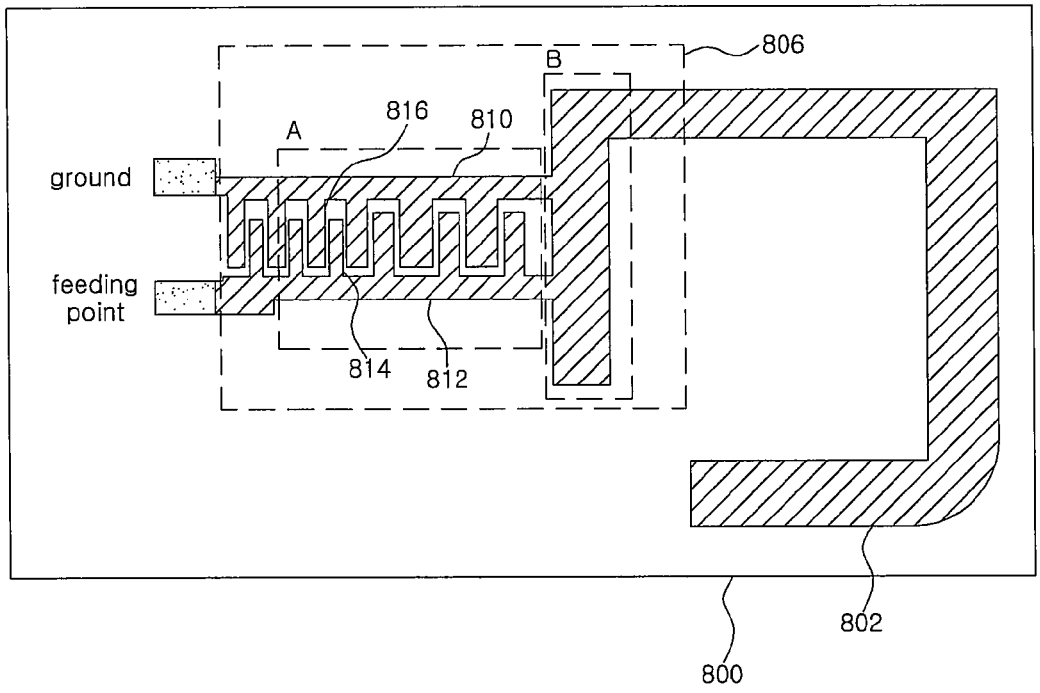
FIG. 8 illustrates the structure of a multi-band internal antenna according to a fourth disclosed embodiment of the present invention.

FIG. 8 illustrates the structure of a multi-band internal antenna according to a fourth disclosed embodiment of the present invention.

Referring to FIG. 8, a multi-band internal antenna according to the fourth disclosed embodiment of the present invention may include a board 800, a radiator 802, and an impedance matching part 804, where the impedance matching part 804 may include a first conductive element 810 electrically coupled to the feeding point, a second conductive element 812 electrically coupled with a ground, a plurality of first coupling elements 814 protruding from the first conductive element 810, and a plurality of second coupling elements 816 protruding from the second conductive element 812.

The components of the antenna according to the fourth disclosed embodiment are substantially the same as those of the second disclosed embodiment, except for the way in which the radiator 802 is joined. Referring to FIG. 8, in an antenna according to the fourth disclosed embodiment, the radiator 802 may extend from the portion where the first conductive element 810 and the second conductive element 812 are coupled. That is, the radiator 802 can extend from the first conductive element 810, as in the embodiments described above, but can also extend from the coupling portion between the first conductive element 810 and the second conductive element 812. The form of the radiator such as that illustrated in FIG. 8, according to the fourth disclosed embodiment, can also be applied to any one of the first to third disclosed embodiments.

Figure 4:
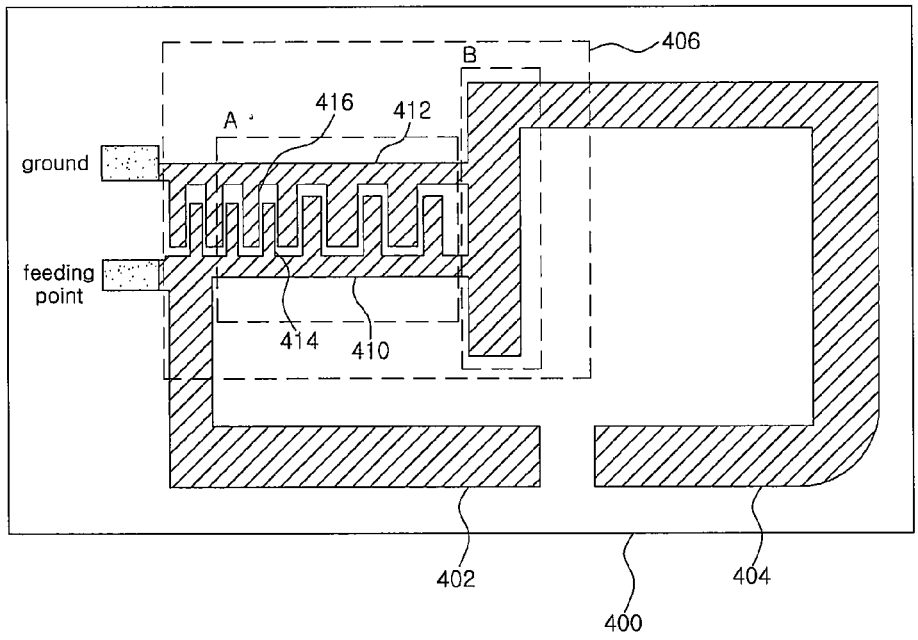
FIG. 4 illustrates the structure of a multi-band internal antenna according to a fourth disclosed embodiment of the present invention.

FIG. 4 illustrates the structure of a multi-band internal antenna according to a fifth disclosed embodiment of the present invention.

Referring to FIG. 4, a multi-band internal antenna according to the fifth disclosed embodiment of the present invention may include a board 400, a first radiator 402, a second radiator 404, and an impedance matching part 406.

In contrast to the first through fourth disclosed embodiments, the fifth disclosed embodiment may include two radiators 402, 404. The two radiators 402, 404 may be included to transceive frequency signals of a greater number of bands. In FIG. 4, the first radiator 402 having a shorter electrical length may be a radiator for radiating frequency signals in a high-frequency band, while the second radiator 404 having a longer electrical length may be a radiator for radiating frequency signals in a low-frequency band. The first radiator 402 may extend from the first conductive element 410, and the second radiator 404 may extend from the coupling position (B) of the first conductive element 410 and the second conductive element 412.

According to an embodiment of the present invention, the first radiator 402 can accommodate the DCS, PCS, WCDMA, and Bluetooth bands, and the second radiator 404 can accommodate the GSM850 and GSM950 bands.

The impedance matching part 406 may include a first conductive element 410, which may be electrically coupled with a feeding point, and a second conductive element 412, which may be electrically coupled with a ground.

Also, the impedance matching part 406 may include a plurality of first coupling elements 414 that protrude from the first conductive element 410 and a plurality of second coupling elements 416 that protrude from the second conductive element 412. Similar to the coupling elements of the second and third disclosed embodiments, the first and second coupling elements 414, 416 enable coupling by a larger capacitance component, diversify the capacitance component, and increase the electrical length of the impedance matching part.

Although FIG. 4 illustrates an impedance matching part similar to that illustrated for the third disclosed embodiment, the impedance matching part as described for any of the first to third disclosed embodiments can be applied just as well.

Also, while FIG. 4 illustrates an example in which the second radiator is bent twice to form a "C" shape, the shape of the second radiator is not thus limited.

When two or more radiation elements are used, as in FIG. 4, it is possible to transmit and receive frequency signals for multiple bands while maintaining wide band characteristics in the high frequency band range.

Figure 5:
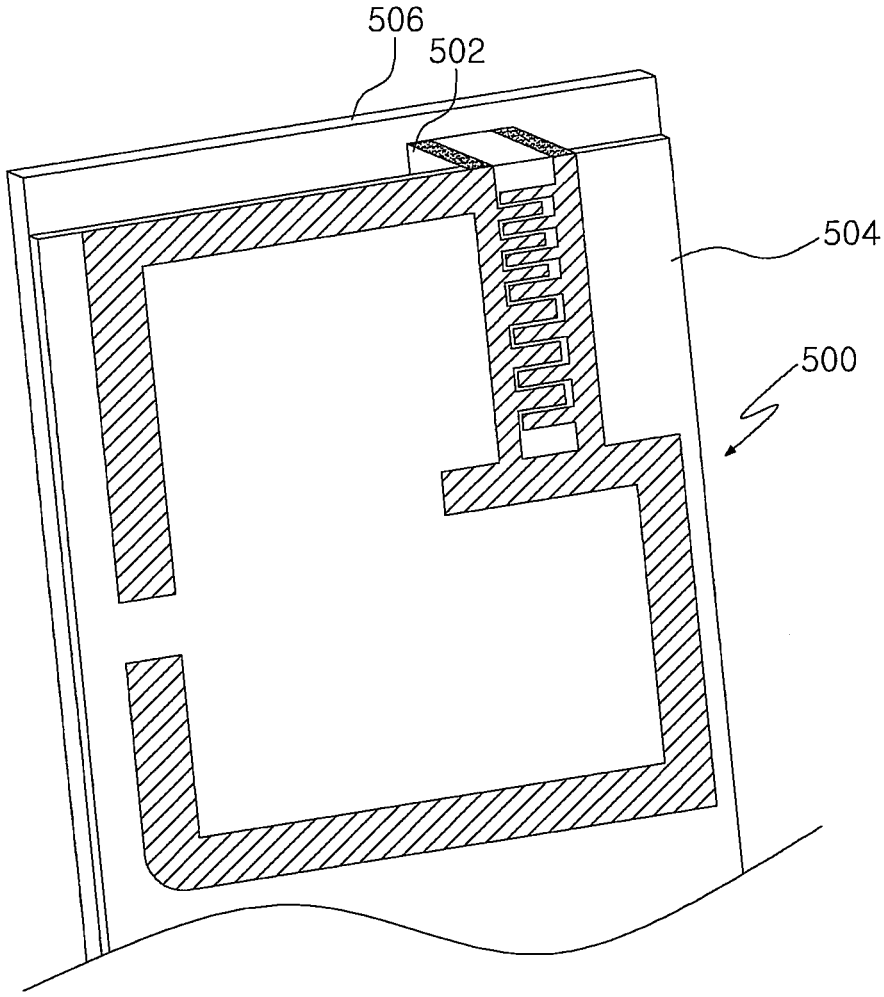
FIG. 5 illustrates the structure of a multi-band internal antenna according to the fourth disclosed embodiment of the present invention, as coupled to the PCB of a terminal.

FIG. 5 illustrates the structure of a multi-band internal antenna according to the fifth disclosed embodiment of the present invention, as coupled to the PCB of a terminal.

Referring to FIG. 5, a carrier 500 having an "L" shape may be coupled to the PCB 506 of a terminal, where the carrier 500 may include a vertical portion 502 and a planar portion 504. The first conductive element and the second conductive element of the impedance matching part may extend along the vertical portion 502 of the carrier, where the first conductive element may be coupled to a feeding line formed on the PCB, and the second conductive element may be coupled with a ground formed on the PCB.

Figure 6:
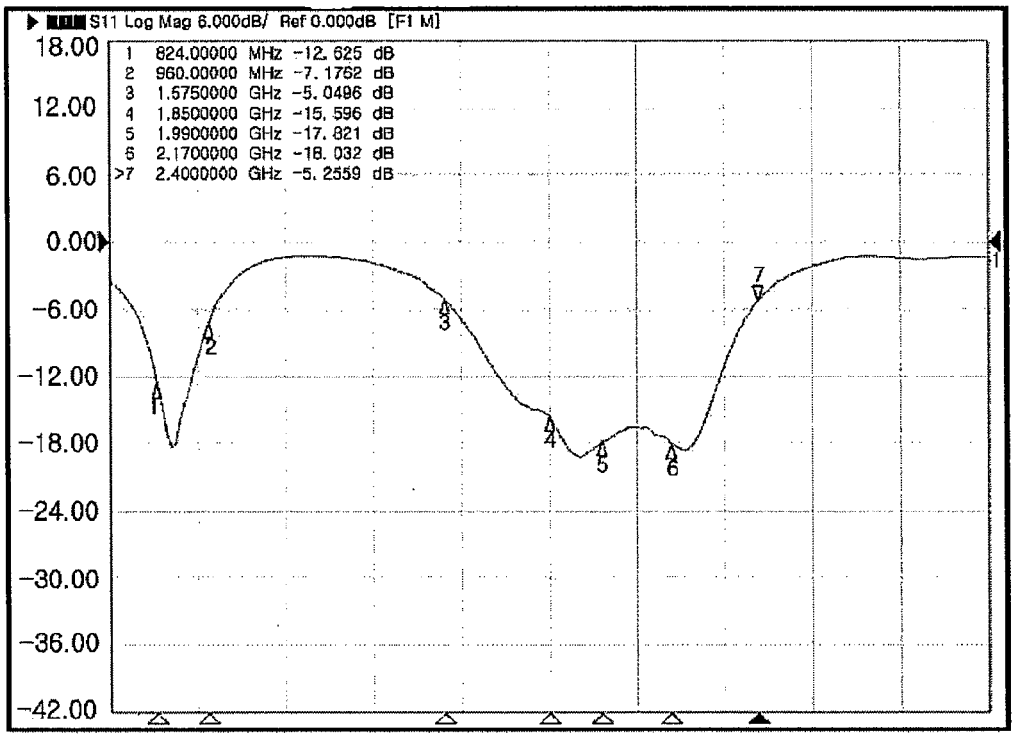
FIG. 6 illustrates the S11 parameters of a multi-band internal antenna according to the fourth disclosed embodiment of the present invention.
Figure 7:
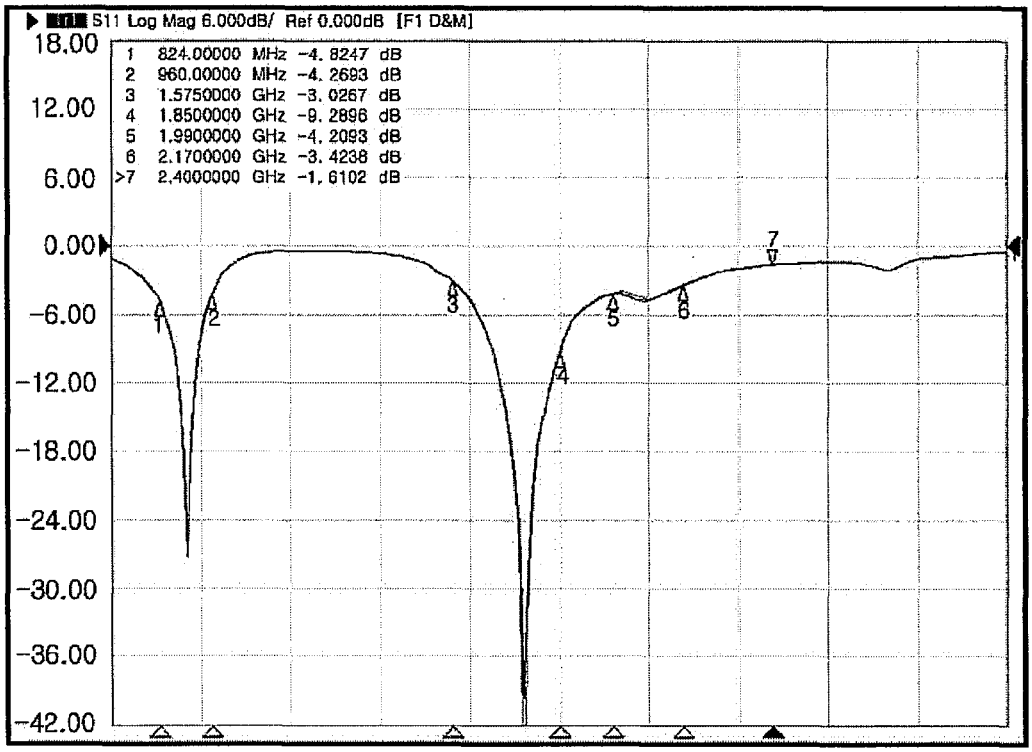
FIG. 7 illustrates the S11 parameters of a typical inverted-F antenna.

FIG. 6 illustrates the S11 parameters of a multi-band internal antenna according to the fifth disclosed embodiment of the present invention, while FIG. 7 illustrates the S11 parameters of a typical inverted-F antenna.

Referring to FIG. 6 and FIG. 7, whereas a typical inverted-F antenna exhibits narrow band characteristics in high-frequency bands, an antenna according to the fourth disclosed embodiment of the present invention exhibits wide band characteristics in high-frequency bands, which enables services for a greater range of bands.

The embodiments of the present invention described in the above are for illustrative purposes only. It is to be appreciated that those of ordinary skill in the art can modify, alter, and make additions to the embodiments without departing from the spirit and scope of the present invention, and that such modification, alterations, and additions are encompassed in the appended claims.

The invention claimed is:

1. A multi-band internal antenna comprising:

an impedance matching part, the impedance matching part comprising:

a first conductive element electrically coupled to a feeding point; and a second conductive element electrically coupled to a ground;

at least one radiator electrically coupled to the first conductive element;

a plurality of first coupling elements protruding from the first conductive element; and wherein the first conductive element and the second conductive element of the impedance matching part are separated by a particular distance to perform coupling matching and are electrically coupled at a pre-designated position, and the first coupling elements and the second coupling elements have partially varying widths and lengths.

2. The multi-band internal antenna of claim 1, wherein an open stub is formed at the position where the first conductive element and the second conductive element are electrically couples.

3. The multi-band internal antenna of claim 1, wherein the first coupling elements and the second coupling elements protruding from the first conductive element and the second conductive element, respectively, form a generally comb-like arrangement.

4. A multi-band internal antenna comprising:

an impedance matching part, the impedance matching part comprising:

a first conductive element electrically coupled to a feeding point; and a second conductive element electrically coupled to a ground;

a radiator;

a plurality of first coupling elements protruding from the first conductive element; and a plurality of second coupling elements protruding from the second conductive element, wherein the first conductive element and the second conductive element of the impedance matching part are separated by a particular distance to perform coupling matching and are electrically coupled at a pre-designated position, and the radiator is electrically coupled to the position where the first conductive element and the second conductive element are electrically coupled, and the first coupling elements and the second coupling elements have partially varying widths and lengths.

5. The multi-band internal antenna of claim 4, wherein an open stub is formed at the position where the first conductive element and the second conductive element are electrically coupled.

6. The multi-band internal antenna of claim 4, wherein the first coupling elements and the second coupling elements protruding from the first conductive element and the second conductive element, respectively, form a generally comb-like arrangement.

* * * * *